US009884415B2

(12) United States Patent
Williams

(10) Patent No.: US 9,884,415 B2
(45) Date of Patent: Feb. 6, 2018

(54) AUTOMOTIVE HOOD SPRING INSTALLER/REMOVER TOOL

(71) Applicant: Paul James Williams, Lockport, IL (US)

(72) Inventor: Paul James Williams, Lockport, IL (US)

( * ) Notice: Subject to any disclaimer, the term of this patent is extended or adjusted under 35 U.S.C. 154(b) by 412 days.

(21) Appl. No.: 14/594,059

(22) Filed: Jan. 9, 2015

(65) Prior Publication Data

US 2015/0190913 A1 Jul. 9, 2015

Related U.S. Application Data

(60) Provisional application No. 61/925,645, filed on Jan. 9, 2014.

(51) Int. Cl.
*B25B 27/30* (2006.01)

(52) U.S. Cl.
CPC ..... *B25B 27/306* (2013.01); *B25B 27/30* (2013.01); *B25B 27/302* (2013.01); *Y10T 29/53622* (2015.01)

(58) Field of Classification Search
CPC ..... B25B 27/306; B25B 27/302; B25B 27/30
See application file for complete search history.

(56) References Cited

U.S. PATENT DOCUMENTS 2,500,221 A * 3/1950 Wagner ..... B25B 27/0035 29/245
2,779,087 A * 1/1957 Shahan ..... E05F 1/1276 254/10.5
2,789,343 A * 4/1957 Millsap ..... B25B 27/023 29/259
2,883,742 A * 4/1959 Prath ..... B21F 35/00 254/10.5
2,885,769 A * 5/1959 Brown ..... B25B 27/306 254/10.5
3,292,250 A * 12/1966 Miller ..... B25B 27/306 29/227
3,747,895 A * 7/1973 Martin ..... B25B 27/306 254/10.5
4,603,461 A * 8/1986 Whippie ..... B25B 27/306 254/10.5
5,477,598 A * 12/1995 Borner, Jr. ..... B25B 27/0035 254/10.5
5,557,833 A * 9/1996 Pool ..... B25B 27/023 29/261
6,393,682 B1 * 5/2002 O'Kane ..... B25B 27/306 29/227
6,434,807 B1 * 8/2002 Begin ..... B25B 27/304 269/3

* cited by examiner

*Primary Examiner* — Christopher R Harmon

(74) *Attorney, Agent, or Firm* — Thompson & Thompson Patents

(57) ABSTRACT

An apparatus to install or remove tension coil springs from spring seat. Apparatus spans beyond the length of a tension coil spring allowing connection to spring ends with a loop and or hook on a threaded shaft. Applying a turning force to threaded shaft will stretch spring to a longer length allowing removal of spring from spring seat. A turning force in opposite direction retracts spring to shorter length allowing installation of spring to spring seat.

16 Claims, 4 Drawing Sheets

AUTOMOTIVE HOOD SPRING INSTALLER/REMOVER TOOL

CROSS-REFERENCE TO RELATED APPLICATIONS

Figure 1:
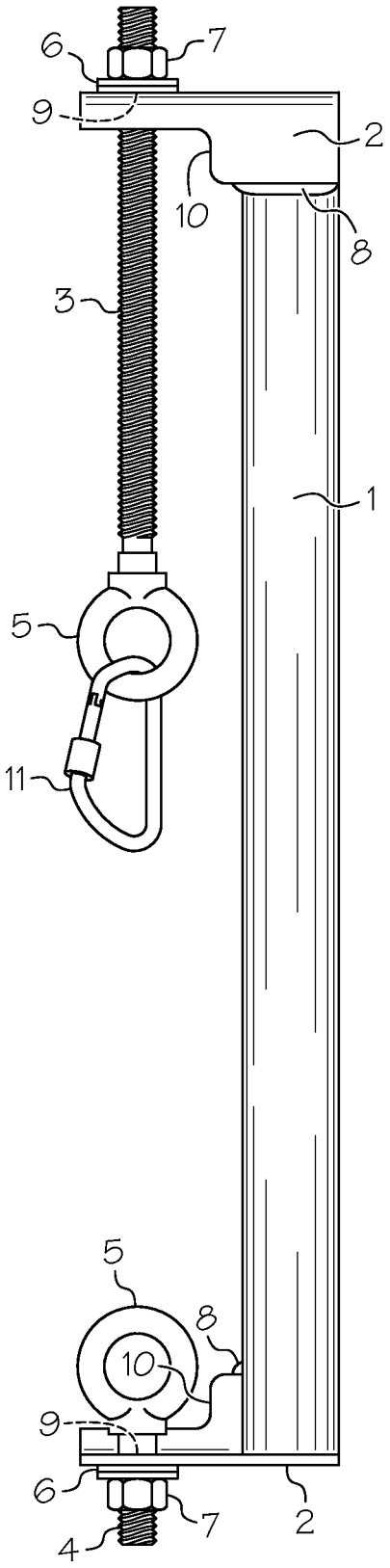
Figure 2:
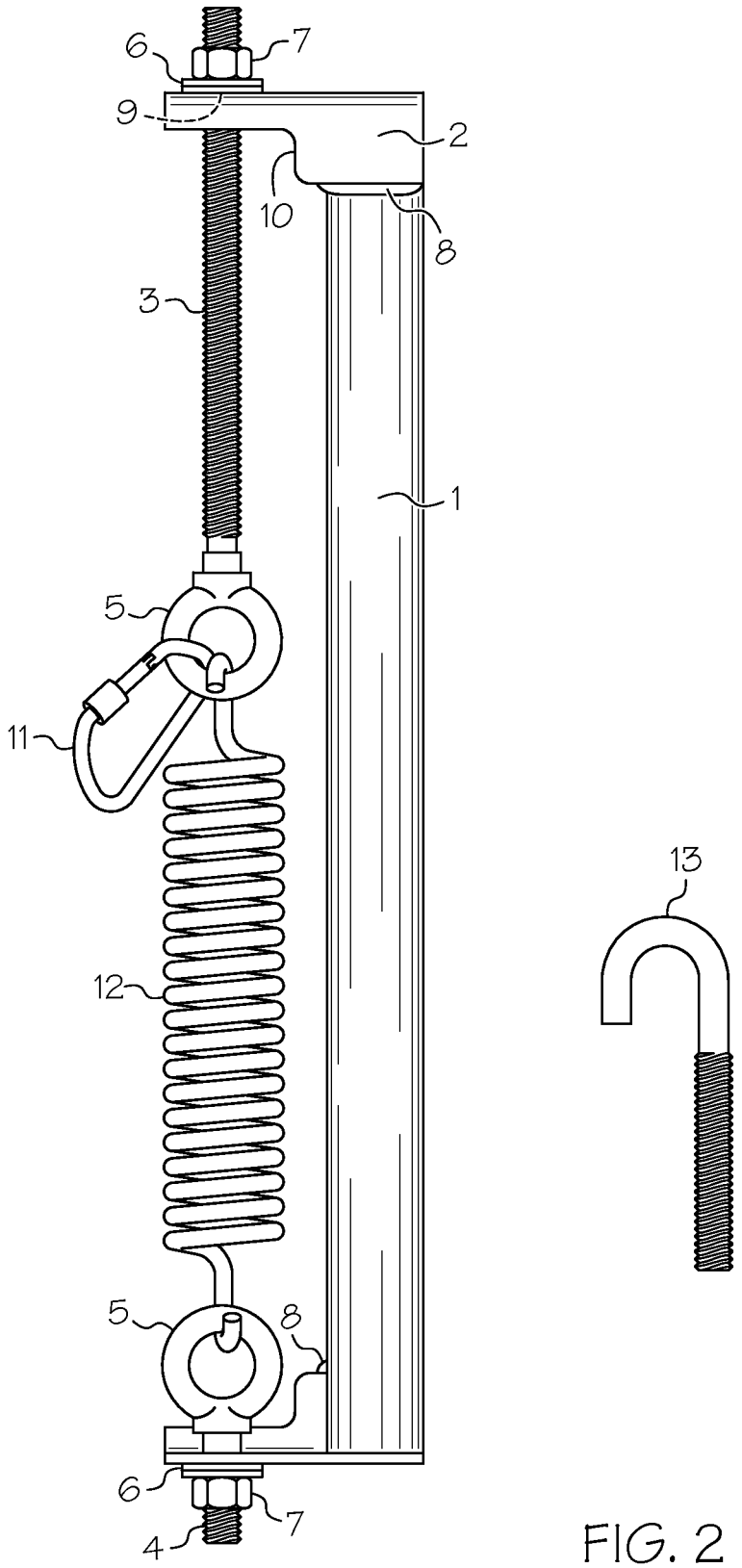
Figure 3:
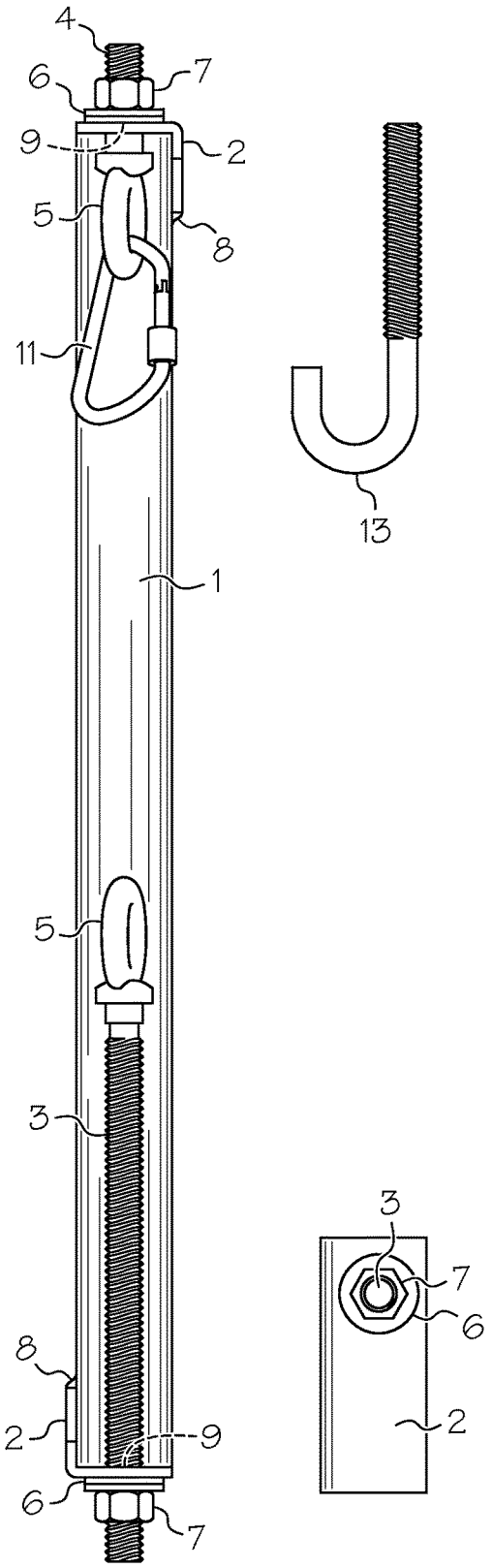
Figure 4:
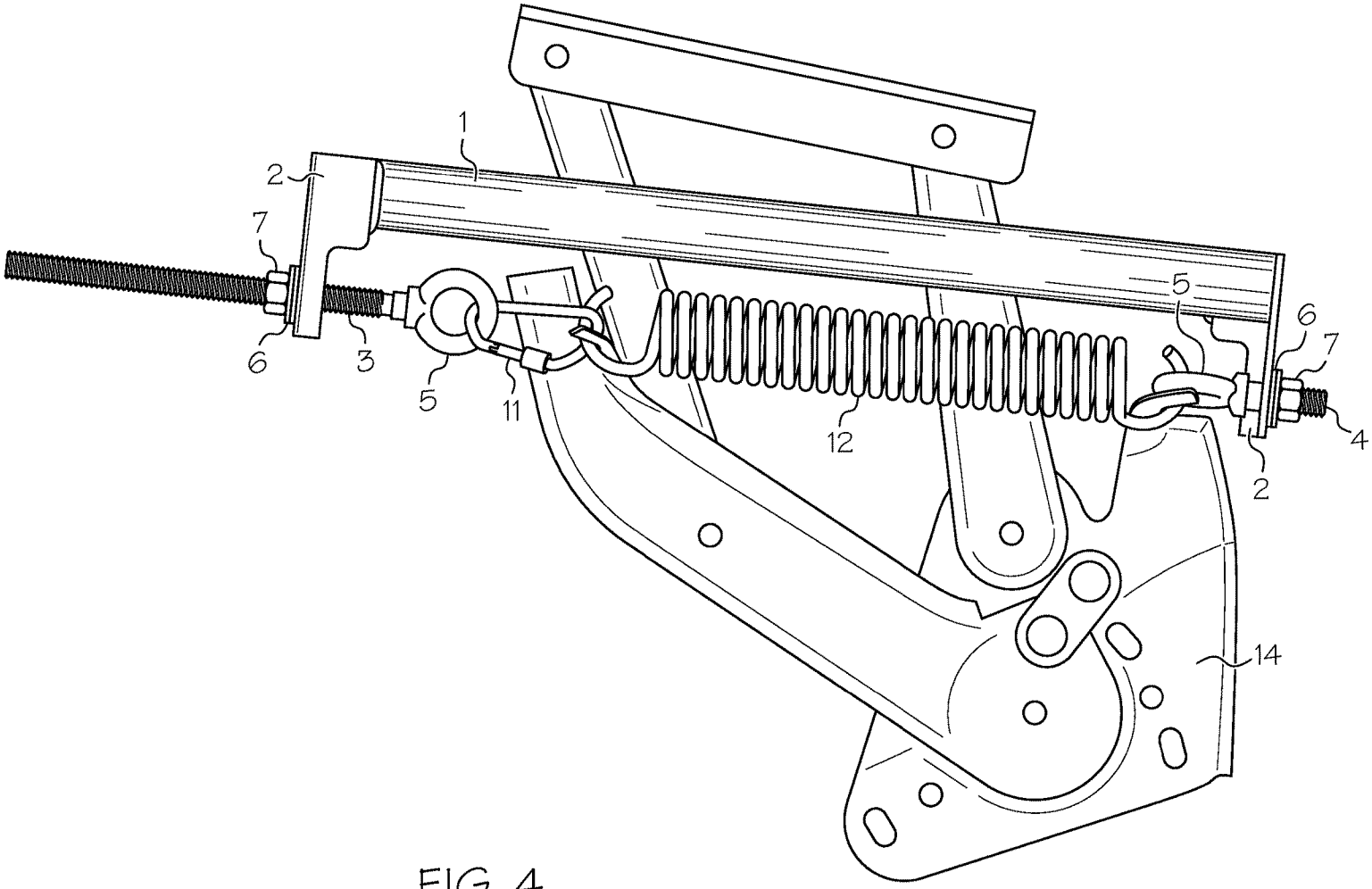

This Application claims the benefit of U.S. Provisional Application No. 61/925,645 filed on Jan. 9, 2014 Titled—Williams Automotive Hood Spring Install/Removal Tool—. The above identified patent application is herein incorporated by reference in its entirety to provide continuity of disclosure.

STATEMENTS REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA EFS WEB

Not Applicable

STATEMENT REGARDING PRIOR DISCLOSURES BY THE INVENTOR OR A JOINT INVENTOR

This Application for Automotive Hood Spring Installer/Remover Tool is claiming the benefits and filing date of U.S. Provisional Application No. 61/925,645 filed on Jan. 9, 2014 titled—Williams Hood Spring Install/Removal Tool.

BACKGROUND OF THE INVENTION

1. Field of the Invention

The present Invention relates to Mechanical Tools. More specifically the present invention is an improvement to a tool that stretches and or retracts automotive tension coil hood springs to ultimately allow user to remove or install springs attached to vehicle's hood hinge or body of vehicle.

A lot of vehicles made from the 1930's thru mid 1980's, utilized tension coil springs. Installed on hood hinges, springs give hoods a counter balance when hood is raised in the upright position to expose engine bay of vehicle. After years of use springs start to loose strength of spring tension and won't fully hold a hood in upright position. If hood falls due to low spring tension the user can be injured. The proper repair would be to replace the hood spring on vehicle. Present invention would allow safe replacement of springs.

Antique and classic cars are currently being restored back to original condition. In order to restore hinges and springs they need to be checked and possibly replaced. In order to check hinges for wear and play, the springs need to be removed to relieve pressure on hinge assembly. Only then can hinge be checked for wear. Springs and hinges are sold separately and springs need to be stretched for installation onto hinge. Present invention will be able to remove and install spring in those instances.

Aftermarket hood makers offer fiberglass replacement hoods instead of steel hoods for looks and weight reduction for race applications. Fiberglass hoods are significantly lighter in weight which makes the stock hood spring rate too strong for fiberglass hoods. Damage is usually caused near the hinge mounting area on the top surface of the hood due to the spring pushing the hinge up to much when hood is lowered and closed. The fiberglass hood would not have the correct weight of counter balance to spring rate. Cracks in the fiberglass and paint occur in that situation. The correct repair would be to replace the stock hood spring with a low-tension spring that is readily available. Present invention would facilitate removal of old springs and installation of new low-tension springs for a proper, safe repair.

2. Description of Related Art

U.S. Pat. No. 3,747,895A—Martin; Marcus, Nov. 4, 1971—"Spring Extender" can both extend and retract tension coil hood springs as per present invention also does. This patent has the frame as the extendable or moving part to expand spring. Current invention has a one piece or solid frame with the said Externally Threaded Shaft being the spring expander or moveable part. Connection to spring end is different than present invention. Notches are used in related art and hooks a loops are used in present invention being a more stable, secure connection process. Present invention has overall less pieces, so making present tool is less expensive to manufacture while not compromising the strength or reliability of said tool.

U.S. Pat. No. 2,779,087—Alva V. Shahan, Jan. 29, 1957—"Device for installing tension springs on automobile hood hinges." States it is a 'stretcher and holder' for automobile hood springs to aid in the installation of hood springs on to hood hinges. This device consists of two parts. One is a spring stretching device and the other part is an extended spring holding bar. After spring is stretched, user must transfer spring from stretcher on to a said holding bar. Said Holding bar is said used due to cramped quarters encountered where the spring needs to be installed on vehicle. Transferring the spring from one tool to another while spring is under great forces of spring pressure poses a risk of safety for the user. If any slippage occurs and the spring slips off of said holder, the spring recoil pressure can cause spring to strike people or objects in its path causing damage. Present invention always has spring connected to tool until spring is seated on spring seats on vehicle hinge and or body, or the spring is released to relaxed state and able to be easily removed off of tool. Present invention is small enough to fit in said cramped quarters of a vehicles engine bay to install or remove spring directly on to vehicle hinge to complete installation or removal without having to remove vehicle hood or hinge from vehicle.

U.S. Pat. No. 2,589,042A—Walter E. Brennemen, Mar. 11, 1952—"Hood Hinge Spring Remover" is a device that is inserted in to spring coils while hood is in upright position. Once device is inserted in spring, user closes hood to the point where spring locks onto device with spring tension. At that point user must reach under hood and grip spring and tool and remove spring from vehicle's hood hinge. Device will hold spring in extended position until spring is put back on vehicle hood hinge with hood lowered, spring seated in seats and spring tension removed from tool by raising vehicle hood to upright position. Device is unable to stretch or retract spring. Also may pose a safety concern with the angle that spring coils are designed. Point of contact for tool can be compromised due to small contact points and slip off from pressures exerted from spring tension. Present invention securely holds spring ends to eliminate any possible slippage and has the ability to stretch and retract spring safely to eliminate the need for any other device to complete hood hinge spring installation or removal process.

BRIEF SUMMARY OF THE INVENTION

The technical object of the present disclosure is to provide an improvement for an automobile tension coil hood spring installer/remover. An apparatus to mechanically stretch or retract vehicle's tension coil hood springs. Allowing removal and installation of automobile tension coil hood springs while on vehicle.

BRIEF DESCRIPTION OF THE SEVERAL VIEWS OF THE DRAWING(S)

FIG. 1 explained:

Frame of tool (1) is a schedule 40 cylindrical pipe cut at 15" long. Frame end brackets (2) are ⅛" thick, 1" wide angle iron cut at 3" long. Frame end brackets (2) are connected to frame of tool (1) by fuse or weld (8) together. Frame end brackets (2) have a ⅜" drilled hole (9) ¾" from outer end. Frame end brackets (2) have about 1½" long×½" deep notch (10) removed from end bracket side for loop and hook clearance. The Long externally threaded shaft (3) is inserted through ⅜" hole (9) in frame end bracket (2). Two flat washers (6) are inserted over longer externally threaded shaft (3) end on outward side of frame end bracket (2). Internally threaded hex nut (7) is threaded onto longer externally threaded shaft (3) end. The loop and or hook (5) faces inward in relation to frame end bracket (2). The shorter externally threaded shaft (4) is inserted in opposing frame end bracket (2). Two flat washers (6) are inserted on shorter externally threaded shaft (4) end on outward side of frame end bracket (2). Internally threaded hex nut (7) is threaded onto end of shorter externally threaded shaft (4). The openable and closeable link (11) is connected to longer externally threaded shaft (3) for adaptability on applications where vehicle hood spring (12) is shorter in length as used on some 1970's era vehicles. J-Hook (13) is used in place of shorter externally threaded shaft (5) when access to vehicle spring end hook is obstructed. J-Hook (13) will install on frame (1) and grab spring similar to shorter externally threaded shaft (5) and allow removal and installation of spring (12) in most instances of spring end obstruction. More specifically on 1965-late 1970's Ford Mustangs.

FIG. 2 Explained:

Vehicle hood spring (12) shown connected to present invention without the use of openable and closeable link (11) and J-Hook (13).

FIG. 3 Explained:

Shows an anal view of present invention. Also shows a front view of Frame end bracket (2) with flat washer (6) and internally threaded hex nut (7) installed on external threads of longer externally threaded shaft (3) on outward side of frame end bracket (2). J-Hook (13) is displayed.

FIG. 4 Explained:

Displaying present invention connected to a vehicle hood spring (12) while vehicle spring (12) is still attached to vehicle hood hinge (14) with the use of openable and closeable link (11)

DETAILED DESCRIPTION OF THE INVENTION

Automotive Hood Spring Installer/Remover Tool comprising:

A straight pipe with extending brackets on each end. End Brackets support externally threaded shafts by means of a threaded or drilled hole. Externally threaded shafts have a hook and or loop at one end and an internally threaded nut on outward side of frame on opposing end. Reference both externally threaded shafts' loops facing inward of frame end brackets. Connect to vehicle hood spring by slipping externally threaded shaft loop over hook end of spring. A turning force is applied to internally threaded nut and the turning force pulls externally threaded rod outward therefore stretching the spring to a longer position. Spring can then be removed from spring seats on vehicle hinge. A turning force on nut in opposite direction will allow externally threaded shaft to move inward therefore retracting the spring to a shorter position. Can be retracted until spring is at a safe, resting, bound position. Spring can then be removed from loops and or hook of tool. Closable link and a J-Hook is provided for adaptability for varying spring lengths and mounting styles of different automobile manufacturers.

The invention claimed is:

1. An automotive hood spring installer/remover tool comprising:

a frame having an elongated body with a first end and a second end;

a first bracket that defines a first hole, wherein the first bracket extends from the first end of the elongated body;

a second bracket that defines a second hole, wherein the second bracket extends from the second end of the elongated body;

a first shaft having a hook or loop at a first end, wherein the first shaft is configured to extend through the first hole with the hook or loop extending toward the second shaft; and a second shaft having a hook or loop at a first end, wherein the second shaft is configured to extend through the second hole, with the hook or loop of the second shaft extending toward the first shaft;

wherein the first and second shaft, when extending through the first and second holes, are generally parallel to the body;

wherein each of the first and second shafts has a second end; and wherein the shafts are externally threaded and the threads extend the length of the shaft from the hook or loop at the first end of the shaft to the second end of the shaft.

2. The automotive hood spring installer/remover tool of claim 1, wherein both the first and second end brackets have clearance notches for the loops or hooks on the first and second shafts respectively.

3. The automotive hood spring installer/remover tool of claim 1, wherein the holes defined by the brackets are sufficiently large to allow the externally threaded shafts to pass through the holes.

4. The automotive hood spring installer/remover tool of claim 1, further comprising a plurality of internally threaded hex nuts, wherein each of the first and second externally threaded shafts accepts one of the plurality of internally threaded hex nuts on the end of the shaft that does not have the hook or loop.

5. The automotive hood spring installer/remover tool of claim 4, further comprising a bearing plate or two flat washers, wherein the bearing plate or two flat washers is disposed on the first shaft between the internally threaded hex nut and the bracket.

6. The automotive hood spring installer/remover tool of claim 4, wherein the plurality of internally threaded hex nuts are of a high strength metal.

7. The automotive hood spring installer/remover tool of claim 6, wherein the high strength metal is grade 8, forged steel, or hardened steel.

8. The automotive hood spring installer/remover tool of claim 1, wherein the first shaft is longer than the second shaft.

9. The automotive hood spring installer/remover tool of claim 1, wherein each of the hooks or loops on the shafts is configured to accept an end of a vehicle hood spring; and wherein, when each end of the vehicle hood spring is secured to one of the hooks or loops, the vehicle hood spring extends along the body between the loops or hooks.

10. The automotive hood spring installer/remover tool of claim 1, wherein the body comprises one of a tube or a solid rod.

11. The automotive hood spring installer/remover tool of claim 1, wherein the first and second brackets extend at a 90 degree angle from the body.

12. The automotive hood spring installer/remover tool of claim 1, wherein the first and second brackets and the body are a single piece.

13. The automotive hood spring installer/remover tool of claim 1, wherein the shafts are made of a high strength metal.

14. The automotive hood spring installer/remover tool of claim 13, wherein the high strength metal is forged steel or hardened steel.

15. The automotive hood spring installer/remover tool of claim 1, further comprising a leverage handle connected to the second end of the first shaft to allow turning of the shaft.

16. The automotive hood spring installer/remover tool of claim 1, further comprising an openable and closable metal link; wherein the metal link is connected to the hook or loop of the first shaft.

* * * * *